US009431709B2

(12) United States Patent
McKinzie, III

(10) Patent No.: US 9,431,709 B2
(45) Date of Patent: Aug. 30, 2016

(54) ARTIFICIAL MAGNETIC CONDUCTOR ANTENNAS WITH SHIELDED FEEDLINES

(71) Applicant: William E. McKinzie, III, Fulton, MD (US)

(72) Inventor: William E. McKinzie, III, Fulton, MD (US)

(73) Assignee: WEMTEC, INC., Fulton, MD (US)

( * ) Notice: Subject to any disclaimer, the term of this patent is extended or adjusted under 35 U.S.C. 154(b) by 551 days.

(21) Appl. No.: 13/852,482

(22) Filed: Mar. 28, 2013

(65) Prior Publication Data

US 2014/0097995 A1 Apr. 10, 2014

Related U.S. Application Data

(60) Provisional application No. 61/852,443, filed on Mar. 15, 2013, provisional application No. 61/686,317, filed on Apr. 3, 2012.

(51) Int. Cl.

| | |
|---|---|
| ***H01Q 9/04*** | (2006.01) |
| ***H01Q 19/10*** | (2006.01) |
| ***H01Q 9/06*** | (2006.01) |
| ***H01Q 9/28*** | (2006.01) |
| ***H01Q 15/00*** | (2006.01) |
| ***H01Q 21/26*** | (2006.01) |

(52) U.S. Cl.

CPC ..... *H01Q 9/0407* (2013.01); *H01Q 9/045* (2013.01); *H01Q 9/065* (2013.01); *H01Q 9/285* (2013.01); *H01Q 15/008* (2013.01); *H01Q 19/10* (2013.01); *H01Q 21/26* (2013.01); *Y10T 29/49016* (2015.01); *Y10T 29/49018* (2015.01)

(58) Field of Classification Search

CPC ..... H01Q 15/008; H01Q 9/0407

See application file for complete search history.

(56) References Cited

U.S. PATENT DOCUMENTS

| | | | | |
|---|---|---|---|---|
| 6,262,495 | B1 | 7/2001 | Yablonovitch et al. | |
| 6,483,481 | B1 * | 11/2002 | Sievenpiper | H01Q 15/008 343/700 MS |
| 7,330,161 | B2 | 2/2008 | Matsugatani et al. | |
| 2003/0011518 | A1 | 1/2003 | Sievenpiper et al. | |
| 2003/0197658 | A1 * | 10/2003 | Lilly | H01Q 1/243 343/909 |

OTHER PUBLICATIONS

M.Salah Toubed, R.Chantalat, M.Hajj, B. Jecko, "High Gain and Broadband Ultra Low Profile EBG Antenna for High Power and Electronic Warfare Applications," *6th European Conference on Antennas and Propagation (EUCAP)*, © 2011 IEEE, pp. 801-803.

(Continued)

*Primary Examiner* — Hoang V Nguyen
*Assistant Examiner* — Michael Bouizza
(74) *Attorney, Agent, or Firm* — Brinks Gilson & Lione

(57) ABSTRACT

An antenna system is described which is comprised of an artificial magnetic conductor (AMC), an antenna element, and a feed network comprised of shielded feedlines whose outer conductor, or shield, is routed through the substrate of the AMC. The feedline outer conductor is connected to both the substantially continuous conductive surface and the array of capacitive patches forming the AMC. The shielded feedline suppresses the excitation of undesired TM modes within the AMC substrate, results in a stable return loss over a frequency range associated with the AMC's high surface impedance and surface wave bandgap.

31 Claims, 17 Drawing Sheets

(56) References Cited

OTHER PUBLICATIONS

M.Salah Toubed, M.Hajj, R. Chantalat, E. Arnaud, B. Jecko, T. Monediere, H. Zhang and Jean-Christophe Diot, "Wide Bandwidth, High-Gain, and Low-Profile EBG Prototype for High Power Applications," *IEEE Antennas and Wireless Propogation Letters*, vol. 10, 2011, pp. 1362-1365.

M. Ziaul Azad and M. Ali, "Novel Wideband Directional Dipole Antenna on a Mushroom Like EBG Structure," *IEEE Transactions on Antennas and Propagation*, vol. 56, No. 5, May 2008, pp. 1242-1250.

A.P. Feresidis, G. Goussetis, S. Wang, J. C. Vardaxoglou, "Artificial Magnetic conductor Surfaces and Their application to Low-Profile High-Gain Planar Antennas," *IEEE Transactions on Antennas and Propagation*, vol. 53, No. 1, Jan. 2005, pp. 209 215.

W.E. McKinzie III and R.R. Fahr, "A Low Profile Polarization Diversity Antenna Built on an Artificial Magnetic Conductor," 2002 *IEEE AP-S Intl. Symp.*, San Antonio, TX, Jun. 16-21, pp. 1-4.

D. Sievenpiper, L. Zhang, R.F. Jimenez Broas, N.G. Alexópolous, E. Yablonovitch, "High-Impedance Electromagnetic Surfaces with a Forbidden Frequency Band," *IEEE Transactions on Microwave Theory and Techniques*, vol. 47, No. 11, Nov. 1999, pp. 2059-2074.

W.E. McKinzie III, R. Hurtado, W. Klimczak, "Artificial Magnetic Conductor Technology Reduces Size and Weight for Precision GPS Antennas," *IEEE Antennas and Propagation Magazine*, vol. 43, No. 3, Jun. 200, pp. 90-94.

* cited by examiner

Dipole and FSS metal layers (M1, M2, and M3)

RF backplane and feed network metal layers (M4 and M5)

(b)

(a)

ARTIFICIAL MAGNETIC CONDUCTOR ANTENNAS WITH SHIELDED FEEDLINES

This application claims priority to U.S. provisional application 61/686,317, filed on Apr. 3, 2012 and U.S. provisional application 61/TBA, filed on Mar. 15, 2013, each of which are incorporated herein by reference.

TECHNICAL FIELD

This application is related to antennas formed using an artificial magnetic conductor (AMC).

BACKGROUND

In antenna systems it is often desirable to reduce the physical size of the radiating structure. A typical example is a microstrip patch antenna. There are well-known engineering trade-offs between the physical height of the antenna and its return loss bandwidth. One technical approach to improve this engineering trade is to employ an artificial magnetic conductor (AMC) such as the high-impedance surface of Sievenpiper et al. in "High-Impedance Electromagnetic Surfaces with a Forbidden Frequency Band," *IEEE Trans. on Microwave Theory and Techniques*, Vol. 47, No. 11, November 1999, pp. 2059-2074. Also see U.S. Pat. No. 6,262,495 entitled "Circuit and method for eliminating surface currents on metals." Planar antenna elements may be placed in close proximity to an AMC surface, as close as 1/1000 of a free space wavelength and radiate efficiently over relatively narrow frequency bands.

A significant issue with AMC-type antennas is the parasitic excitation of TM modes by the feed network. The wire probes or vias are typically routed vertically from the RF backplane through the AMC substrate to feed an antenna element located next to the front exterior surface of the AMC. These wire probes have an interaction (that is, a coupling) with any vertical electric field inside the AMC substrate, including those fields associated with TM surface wave modes. Even though the bound TM surface wave mode is cutoff, evanescent TM modes will still be excited by the wire probes. Such evanescent TM modes are parasitic modes which store unwanted energy, raising the antenna Q factor, and are manifest as resonances in the antenna's return loss. Center-fed elements which require balanced feeds may be excited on an AMC surface by routing a two-wire line vertically through the AMC substrate. See, for example, Azad et al. in "Novel Wideband Directional Dipole Antenna on a Mushroom Like EBG Structure," *IEEE Trans. On Antennas and Propagation, Vol.* 56, No. 5, May 2008, pp 1242-1250. However, capacitive discontinuities are present on this balanced feedline at the plane where the feedline passes through the RF backplane of the AMC, and at any plane where the feedline passes through a capacitive patch or between two adjacent capacitive patches at the front exterior surface of the AMC. The capacitive discontinuities limit the achievable return loss bandwidth.

SUMMARY

An electromagnetic radiating structure is disclosed, the structure having a frequency selective surface (FSS) comprised of a coplanar array of conductive patches; a substantially continuous conductive plane spaced apart from the FSS; and, a conductive portion disposed with respect to the FSS so as to be more distal from the conductive plane and a plurality of conductive elements each element connecting a conductive patch to the conductive plane. A transmission line having an outer conductor is routed from the conductive plane to the FSS such that an outer conductor of the transmission line is connected to the conductive plane and to a conductive patch of the array of conductive patches; and, the inner conductor of the transmission line is connected to the conductive portion.

The FSS and the conductive plane may be separated by a dielectric layer, which may be a solid, air or a honeycomb, or the like. In an aspect, the conductive portion is an antenna which may be disposed parallel to the FSS and may be a monopole, dipole, a plurality of antennas of various types, or the like In an aspect, the conductive elements may be formed as plated through holes (PTH) in a printed circuit board (PCB). In another aspect, the conductive elements are formed as pins, wires, stakes, or the like, such that at least one conductive connects a conductive patch to the conductive plane and the plurality of conductive elements form a stable structure. The dielectric may be air when pins are used. Where pins are used, the conductive portions may be swaged or deviate from a linear shape so as to provide a predefined depth for inserting the pins during a manufacturing process.

In yet another aspect, the antenna may be a balanced structure having a first and a second portion, and the transmission line may comprise a first transmission line and a second transmission line. The outer conductor of the first transmission line and the outer conductor of the second transmission line may be connected to the substantially continuous conductive plane and to a conductive patch of the array of conductive patches. The inner conductor of the first and the second inner conductors may be connected to the first and the second conductive portions, respectively. In such a balanced configuration, the transmission lines may be fed with voltages having equal amplitude and opposite phase.

A feed network may be positioned on an opposite side of the conductive surface from the FSS and a impedance matching network connected between the inner conductor of the transmission line and the antenna element.

In another aspect, an antenna system may have an artificial magnetic conductor configured to have a bandgap, comprised of a frequency selective surface (FSS), a substantially continuous conductive surface disposed apart from the FSS; and a plurality of conductive elements connecting the FSS and the substantially continuous conductive surface. The FSS and the substantially continuous conductive surface may be separated by a dielectric layer, which may be a solid, a honeycomb or air, and an antenna may be disposed such that the FSS is disposed between the antenna and the conductive surface.

A shielded transmission line having an outer conductor and an inner conductor penetrates the substantially continuous conductive surface may have an outer conductor thereof connected to the FSS and to the substantially continuous conductive surface. The inner conductor may be connected to a feed point of the antenna. The shielded transmission line may be, for example, a semi-rigid or rigid coaxial cable.

The FSS, the substantially continuous conductive plane and the conductive elements form an artificial magnetic conductor (AMC) and radiation occurs from leaky surface waves within the bandgap of the AMC.

A method for manufacturing an antenna system is disclosed, including the steps of: forming an artificial magnetic conductor (AMC) comprising disposing a coplanar array of conductive patches and a substantially continuous conductive surface so as to be separated by a dielectric layer; and electrically connecting a subset of the conductive patches to the substantially continuous conductive surface. The method further includes: positioning an antenna element such that the array of conductive patches lies between the antenna and the substantially continuous conductive surface; providing a transmission line having an outer conductor and an inner conductor; routing the transmission line through the region bounded by the array of conductive patches and the substantially continuous conductive surface; connecting the outer conductor of the transmission lines to the substantially continuous conductive surface and to a conductive patch of the array of conductive patches, and connecting the inner conductor of the transmission line to the antenna element.

The AMC may be sized and dimensioned such that an electromagnetic surface-wave bandgap is formed in a frequency range associated with radiation of the antenna. A surface-wave bandgap is a range of frequencies where the AMC suppresses bound surface-wave modes. This range of frequencies may not be the same as the high-impedance bandwidth where the phase of a reflection coefficient of the surface is between about +90 and −90 degrees, and the magnitude of the reflection coefficient is near unity. The AMC having electrical connections between the FSS and a backplane exhibits a surface-wave bandgap and a high-impedance bandwidth. These frequency regimes may overlap sufficiently so as to permit the realization of a broadband antenna with good efficiency and good return loss over a desired operating bandwidth.

BRIEF DESCRIPTION OF THE DRAWINGS

FIG. 11 shows the reflection coefficient plot and the corresponding Smith Chart plot of impedance for an example AMC antenna;

DETAILED DESCRIPTION

Reference will now be made in detail to numerous examples; however, it will be understood that claimed invention is not limited to such examples. Like numbered elements in the same or different drawings perform equivalent functions. In the following description, numerous specific details are set forth in the examples in order to provide a thorough understanding of the subject matter of the claims which, however, may be practiced without some or all of these specific details. In other instances, well known process operations or structures have not been described in detail in order not to unnecessarily obscure the description.

When describing a particular example, the example may include a particular feature, structure, or characteristic, but every example may not necessarily include the particular feature, structure or characteristic. This should not be taken as a suggestion or implication that the features, structure or characteristics of two or more examples should not or could not be combined, except when such a combination is explicitly excluded. When a particular feature, structure, or characteristic is described in connection with an example, a person skilled in the art may give effect to such feature, structure or characteristic in connection with other examples, whether or not explicitly described.

Unless otherwise noted, the term conductor or adjective conductive refers to a good quality conductor where the effective surface resistance is less than about 30 milliohms per square. The phrase "electrically connected" means that an ohmic contact is achieved between two conductive bodies wherein the series resistance is less than about 0.1 Ohm. The term dielectric refers to a low loss dielectric material where the dielectric loss tangent is about 0.02 or less.

Figure 1:
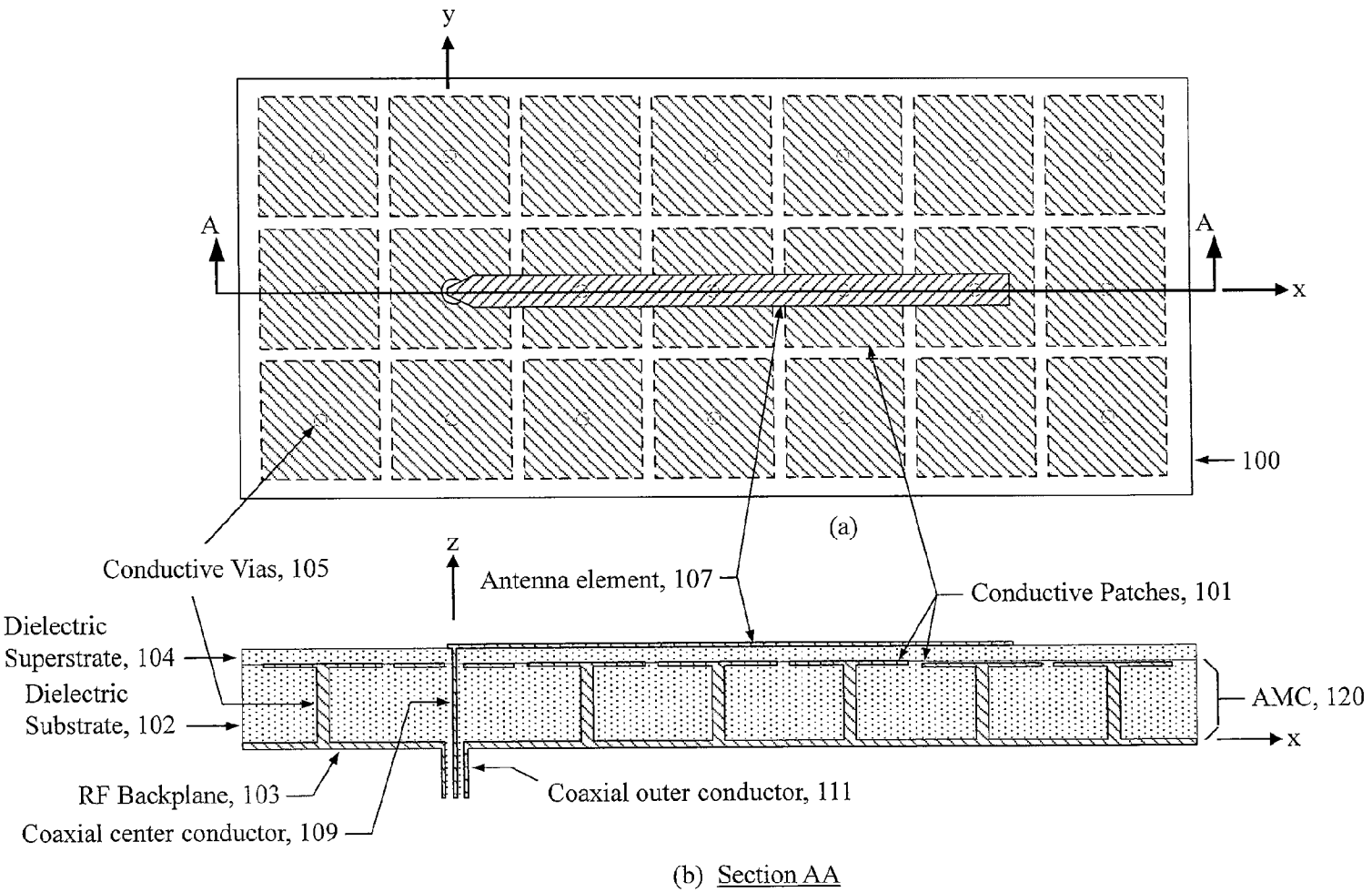
Fig. 1 (Prior Art)
FIG. 1 shows orthogonal views of a prior art AMC antenna element which uses an unshielded and unbalanced feedline.

FIG. 1 shows a known antenna system 100 formed to include an artificial magnetic conductor (AMC) 120. The AMC 120 is comprised of a coplanar array of conductive patches 101, formed as a conductive layer on the upper surface of a dielectric substrate 102, which is disposed parallel to a conductive RF backplane 103. The RF backplane is typically a solid conductive (metal) surface without holes or slots of a size that would have an effect at the wavelength of operation. The AMC also includes an array of conductive vias 105 which electrically connect a center of a conductive patch 101 to the RF backplane 103. The vias 105 are typically plated through holes in printed circuit board (PCB) embodiments of AMCs. This type of AMC has been called a "high-impedance surface". Herein, the structure will be called an AMC because the application is an antenna system, and the approximation of a zero tangential magnetic field at the upper surface of the AMC is a feature that enables a low-profile antenna element. In the literature, the term AMC may include a broad range of planar periodic structures comprised of metallic and dielectric materials which exhibit a reflection phase of zero degrees at the surface thereof at at least one frequency. Many of these AMCs examples have an array of coplanar capacitive patches and a conductive RF backplane, but do not have interconnecting vias. But, conductive vias are needed to suppress the propagation of TM mode surface waves across the AMC, and this suppression results in improved antenna efficiency. Herein, the term "AMC" will refer to a Sievenpiper high-impedance surface which includes at least one via per unit cell.

The purpose of the antenna element(s) is to act as a transformer to excite TE mode surface waves which leak off the entire AMC surface. The electric field in the gaps between capacitive patches may be considered as the direct source of radiation.

A unidirectional low-profile antenna element 100 can be realized by placing a planar conductive antenna element 107 in close proximity to an AMC surface, typically with a separation distance of $\lambda_O/1000$ to $\lambda_O/100$ where $\lambda_O$ is a free space wavelength. This antenna element 100 is unidirectional as it radiates most of its power into the upper hemisphere. The antenna element 107 is sometimes called a bent-wire monopole. The monopole is typically excited at one end by a coaxial center conductor which extends through the dielectric substrate 102 and the dielectric superstrate 104. The insulating superstrate 104 provides mechanical support for the antenna element 107. Often the AMC antenna is fed by a coaxial transmission line whose outer conductor 111 is electrically connected to the RF backplane 103.

The AMC antenna FIG. 1 has performance limitations of bandwidth, parasitic spurious responses, and weight. The return loss bandwidth is approximately proportional to the thickness of the dielectric substrate 102, but the 10 dB return-loss bandwidth is typically limited to between 5% and 10% of the center frequency as the cost and mass of the AMC grows with thickness. In-band spurious responses, or resonances, appear in the return loss. Such spurious responses may be caused by the excitation of TM modes inside the AMC by the vertical center conductor 109 of the coaxial transmission line. There is an interaction between the currents on the coaxial center conductor 109 and the z-axis electric fields of the TM modes. This causes the unshielded feedline of the center conductor to couple power into parasitic TM modes, which do not radiate. A properly designed antenna will have an AMC 120 which exhibits a surface-wave bandgap spanning the desired operating frequency range, and the TM modes are cutoff such that they will not propagate. However, evanescent TM modes can be excited within the AMC 120 from an unshielded feedline, and these modes store energy and raise the antenna Q. This compromises the antenna bandwidth.

Figure 2:
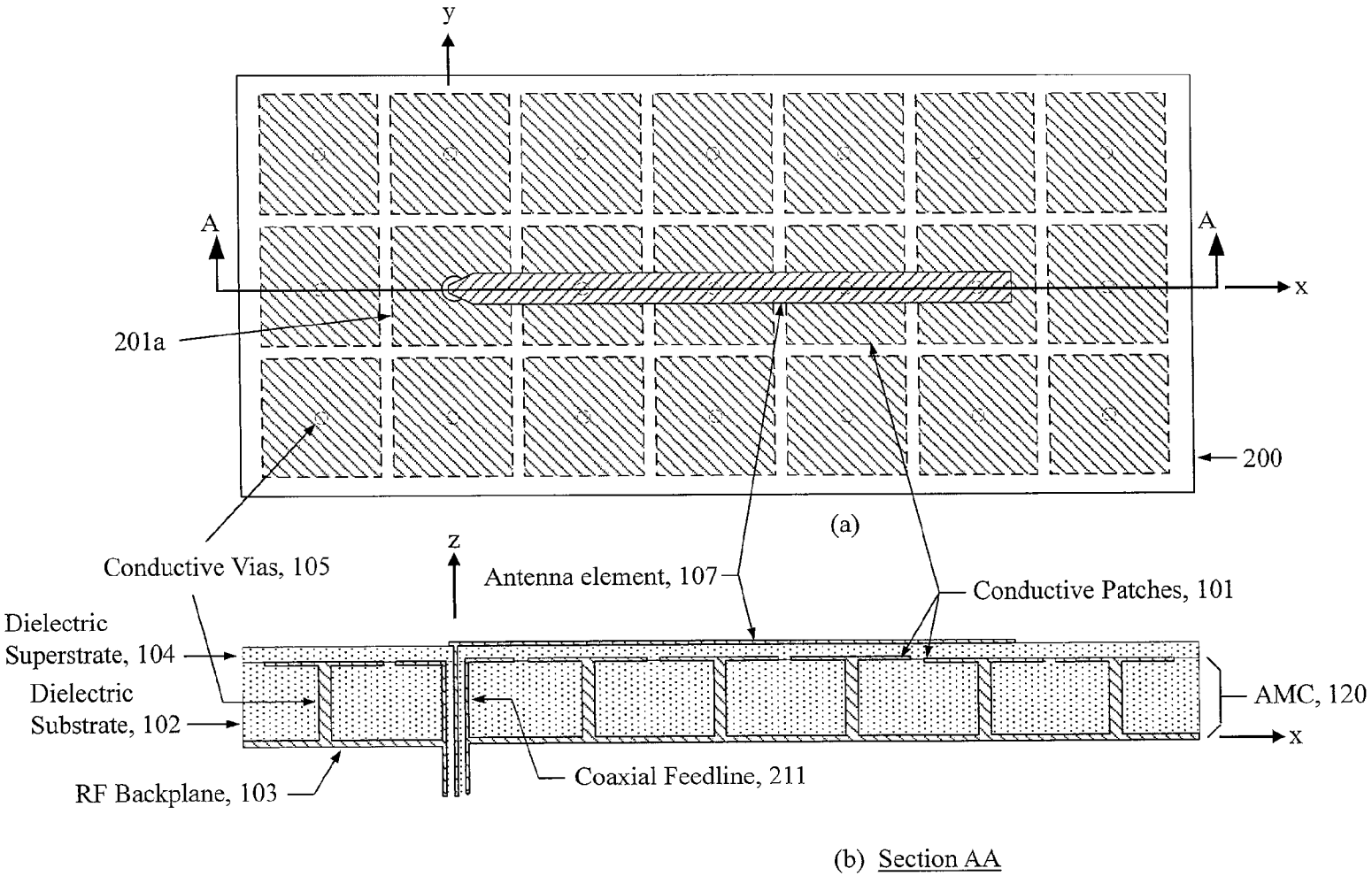
FIG. 2 shows orthogonal views of an embodiment of an AMC antenna element which uses an unbalanced feedline that is shielded within the AMC.

An antenna example having a shielded coaxial feedline is shown in FIG. 2. Antenna 200 is similar to antenna 100 but the outer conductor of the coaxial transmission line 211 traverses the dielectric substrate 102. The outer conductor 211 of the coaxial transmission line is electrically connected to both the RF backplane 103 and to the conductive patch 201*a* of the FSS through which the center conductor of the coaxial feedline passes. A single conductive patch 201*a* is connected to the coaxial outer conductor 211. Routing the shielded coaxial transmission line through the dielectric substrate 102 as shown in FIG. 2 reduces the excitation of parasitic TM modes within the AMC and results in a more broadband return loss without in-band spurious responses associated with resonances. In a conventional design the coaxial cable terminates at the RF backplane and only a single conductor is above the backplane to excite the antenna element.

A shielded feedline may be manufactured in a printed circuit AMC by, for example, forming a blind plated thru hole (PTH) in the dielectric substrate 102, inserting a coaxial cable into this PTH from the RF backplane side and soldering the coaxial cable into the PTH with solder applied to the RF backplane. The coaxial cable may be pre-cut to have an extended center conductor which, after insertion, passes through a different smaller diameter PTH formed in the dielectric superstrate 104 at the end of the antenna element 107. The center conductor connection can be formed to the antenna element 107 by soldering from the antenna element side.

Figure 3:
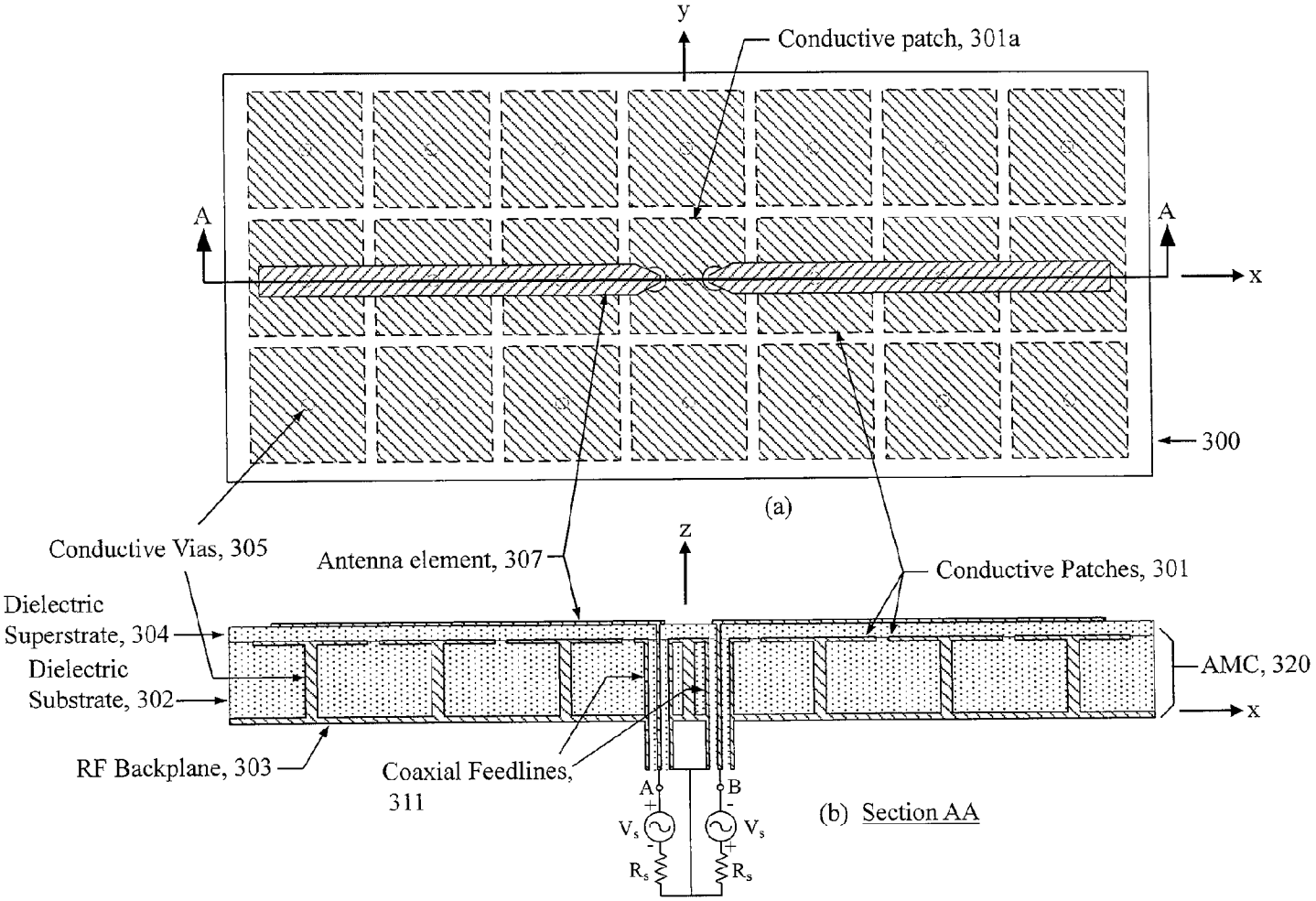
FIG. 3 shows orthogonal views of an embodiment of an AMC antenna element which uses a balanced pair of shielded coaxial feedlines wherein the outer conductors terminate on the same conductive patch.

FIG. 3 shows another example of an AMC antenna system 300 where the antenna element 307 is a planar dipole. This dipole is symmetric about the yz plane. The feedlines 311 are parallel coaxial cables of the equal length and characteristic impedance, and may be excited by a balanced source shown schematically at the bottom of FIG. 3(*b*) as a Thevenin equivalent circuit. Terminals A and B are driven out of phase with equal amplitude voltage sources. The outer conductors of the coaxial feedlines 311 may be electrically connected to both the conductive RF backplane 303 and to a common conductive patch 301*a*.

The antenna embodiment 300 with its dipole antenna element and balanced feedlines: (1) produces a broadside main beam with no beam squint; (2) has a broader return loss bandwidth than a bent-wire monopole element assuming the same AMC design; and, (3) usually has higher directivity than a bent-wire monopole since a larger effective aperture can be created.

Figure 4:
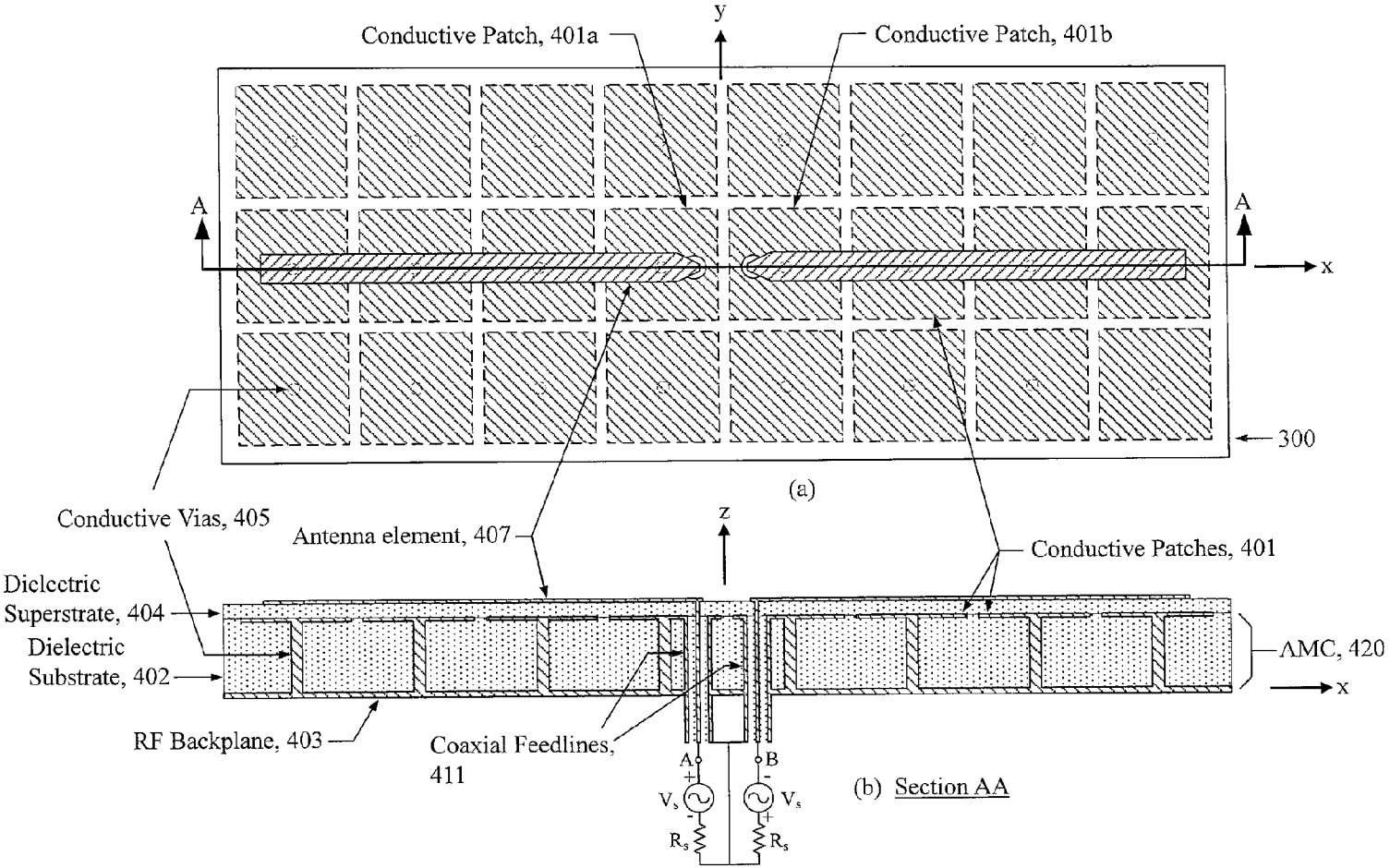
FIG. 4 shows orthogonal views of another embodiment of an AMC antenna element which uses a balanced pair of shielded coaxial feedlines wherein the outer conductors terminate on adjacent conductive patches.

FIG. 4 shows another example of an AMC antenna system 400 where the antenna element 407 is a planar dipole which is symmetric about the yz plane. The feedlines 411 are parallel coaxial cables of a same length and a same characteristic impedance, which may be excited by a balanced source, shown schematically at the bottom of FIG. 4(*b*) as a Thevenin equivalent circuit. Terminals A and B are driven out of phase with equal amplitude voltage sources. The outer conductors of the coaxial feedlines 411 are electrically connected to the conductive RF backplane 403 and to adjacent conductive patches 401*a* and 401*b*. Because of the balanced feed network and the symmetry of the coaxial feedlines about the yz plane, the yz plane is a virtual ground plane, as was the case in the antenna shown in FIG. 3.

The shielded feedlines shown in FIGS. 2, 3, and 4 as 211, 311, and 411 may have an outer conductor having a variety of cross sectional shapes. These feedlines may be filled with a physical dielectric insulator between the inner and outer conductors, or it may be, for example, an air-filled coaxial feedline, as is known in the art.

The AMC antenna embodiments of FIG. 1 through 4 have a dielectric substrate 102, 302, and 402. The bandwidth of the surface-wave bandgap in a Sievenpiper AMC increases as the permittivity of the AMC dielectric substrate is decreased. For example, see FIGS. 17 and 18 in Sergio Clavijo et. al., "Design Methodology for Sievenpiper High-Impedance Surfaces: An Artificial Magnetic conductor for Positive Gain Electrically Small Antennas," *IEEE Trans. on Antennas and Propagation*, Vol. 51, No. 10, October 2003. This results in an improved return loss bandwidth for an antenna system fabricated with an AMC. Therefore it may be desirable to reduce the relative permittivity of dielectric substrates 102, 302, and 402. In the limit, the AMC dielectric substrate may be replaced by air. We shall call this an air-core AMC. An "air-core" AMC has a dielectric substrate that is air, or has an equivalent relative permittivity that is close to unity as would result from using a foam or a honeycomb structure. So, the structure may include dielectric elements that are used for physical support, or the like.

The dielectric layers shown in the AMC antennas of FIGS. 2-4 are primarily used for mechanical support of the conductive vias, patches and antenna elements in a PCB construction. In some examples, these conductors may be self-supporting where the dielectric layers are either minimized or removed entirely and replaced with air. Self-supporting AMC antennas may be fabricated with MEMS fabrication techniques such as surface micromachining. Three-dimensional printing may also be employed to fabricate AMC antennas which have a very limited volume of dielectric materials relative to the volume of the AMC antenna.

In another example, an air-core AMC may be realized using pressed-pin technology. Vias which connect the conductive patches 101, 301, or 401 to the RF backplane 103, 303, or 403 may be replaced with a metallic wire or pin. This conductive pin may be formed from square wire, and may be pressed into an upper printed wiring board that forms the array of capacitive patches and the antenna element(s) and inserted into an array of holes formed in the RF backplane. The pins may be soldered for a good mechanical and electrical connection.

Alternatively, pins may be pressed into a lower PCB which includes a ground plane layer for the RF backplane. This forms a bed of nails upon which an upper printed wiring board may be placed and soldered together. An air gap may be left between the PCBs to form the air-core AMC.

The use of pressed pins to form an air-core AMC relative to using a solid printed wiring board laminate which has been drilled and plated to form vias permits an air-core AMC to be designed to have almost any thickness, since the length of wire pins can be customized. This allows the antenna designer to more flexibly use the AMC thickness as a design parameter, when compared with printed circuit laminates. Typical pin lengths may vary from 0.25 inches to 2.5 inches for designs having center frequencies ranging from about 300 MHz to about 3000 MHz, although this range is not the limit for pin lengths.

An air-core AMC, such as one formed by the use of pins, weighs less than a similar height AMC fabricated as a solid printed wiring board which may be advantageous for mobile, automotive, and airborne applications. The cost of fabricating a pressed pin AMC may be less than the cost of a solid PCB AMC since the laminate(s) required for dielectric substrates 102, 302, or 402 have been eliminated.

Pressed pins may be mass produced on an automated machine which cuts the pins from a reel of continuous wire and miters the ends for ease of alignment and insertion. Swages can also be formed anywhere along the length of the pin as a means to set the insertion depth of the pin. The fabrication of AMC antennas using pressed pins may be advantageous for use in the frequency range below about 2 GHz because it is a relatively low cost manufacturing technique for producing AMC antennas with a return-loss bandwidth of 35% to 40%.

Figure 5:
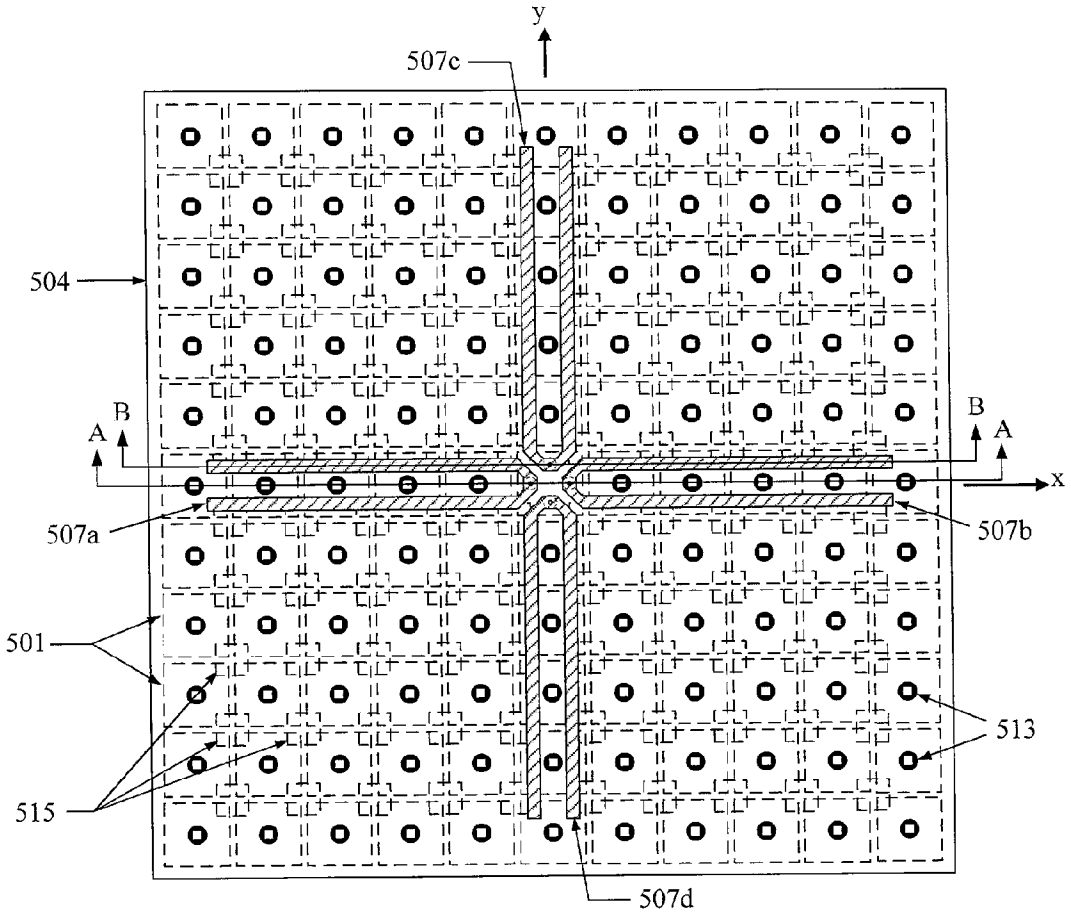
FIG. 5 shows a plan view of the dipole and capacitive FSS layers of another embodiment of an antenna system.

FIG. 5 shows a plan view of a dual-polarized air-core AMC antenna element which employs pressed pins as a construction technique. The upper PCB 504 shown in FIG. 5 includes three metal layers: one layer for the antenna elements, and two layers for conductive patch layers. The patch layers are shown as hidden lines in FIG. 5. Metal layer M1 is the top metal layer of the PCB, and it contains the antenna elements 507*a*, 507*b*, 507*c*, and 507*d*. Antenna elements 507*a* and 507*b* form a horizontally polarized (x axis polarized) balanced dipole antenna. Antenna elements 507*c* and 507*d* form a vertically polarized (y axis polarized) balanced dipole antenna. Each arm of the dipole is bifurcated to avoid an interference fit with capture pads 513 used for the PTHs that accept pressed pins extending through the PCB. A minimum board thickness may be required to capture a pressed pin and even more board thickness (about 0.062 inches) may be used for mechanical integrity. In an example, the multilayer PCB 504 may be a three metal layer board with approximate thickness of 0.062 inches.

Shown in FIG. 5 is an 11×11 array of conductive capture pads 513 which form the top of PTHs used for the pressed pins. These pins are placed at about the center of a unit cell in the periodic structure of the AMC. Each pin may be connected to an internal square conductive patch 501 which resides on metal layer M2. The center unit cell of the AMC of this example does not have a pressed pin as patch 501*c* is grounded to the RF backplane by a set of four coaxial cables which are described further in conjunction with FIGS. 7 and 8. The periodic array of patches 501 form a capacitive frequency selective surface (FSS). The capacitance per square of this surface is increased by the addition of a second array of coplanar patches 515 which resides on metal layer M3. In this example, the second array of patches 515 is offset from the first array of patches 501 by one-half of a period in x and y. An increase in capacitance per square is achieved by parallel-plate capacitance between patches 501 and 515. The combination of conductive patches 501, 515, and the PCB laminate that separates the patches is the capacitive FSS.

Figure 6:
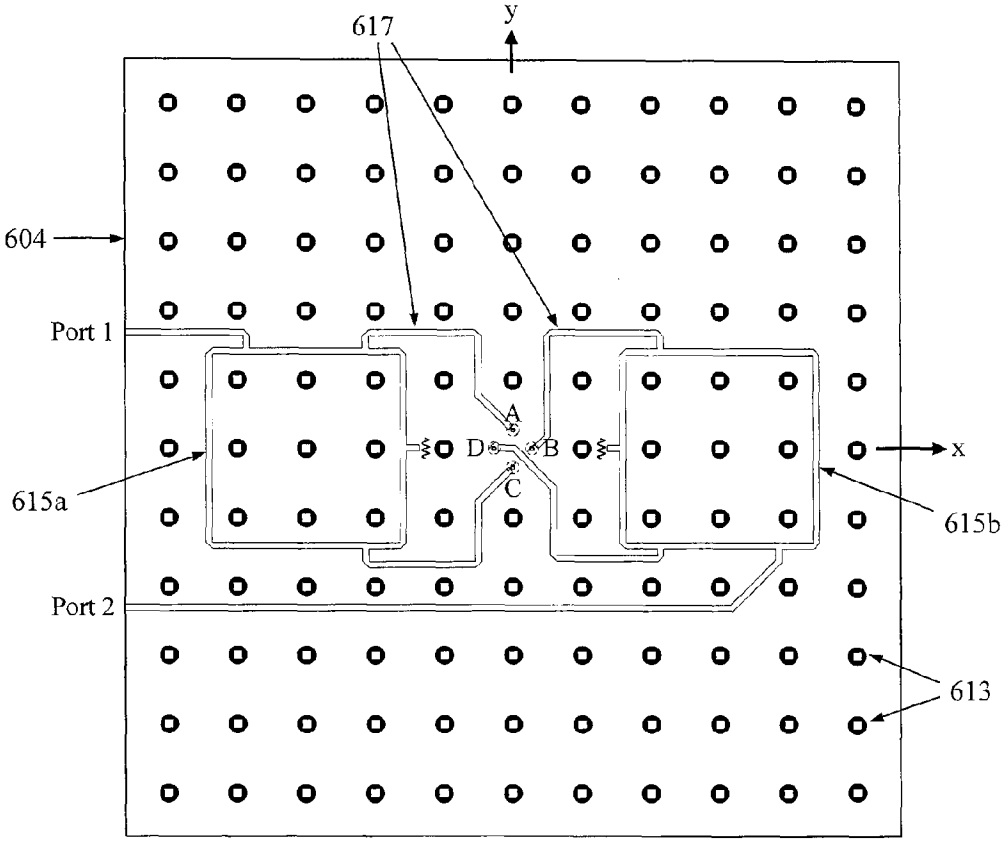
FIG. 6 shows a plan view of an exemplary feed network layer for the embodiment of FIG. 5.

FIG. 6 shows a plan view of the bottom PCB 604 in the dual polarized air-core AMC antenna element. This example is also a three-metal-layer PCB with an array of PTHs to accommodate the 11×11 array of pressed pins in AMC unit cells. Top and bottom metal layers M4 and M6, respectively, are substantially continuous metal surfaces with circular apertures in a solder mask identified as label 613. A solder mask is applied to substantially the entire surface of metal layers M4 and M6, except where a pressed pin is to be inserted.

The center metal layer M5 in PCB 604 forms a stripline feed network 617 comprised of two rat-race couplers used as 180° power dividers. These are conventional 6λ/4 circumference rat-race couplers which are laid out as a square to avoid the PTHs of the pressed pins. The difference ports for each rat-race coupler are used to feed the dipoles and the coupler sum ports are terminated with matched loads. Rat-race coupler 615*a* is used to feed ports A and C near the center of the PCB 604 which ultimately excite the vertically-polarized dipole arms. Rat-race coupler 615*b* is used to feed ports B and D near the center of the PCB 604 which ultimately excite the horizontally-polarized dipole arms. Ideally, port A and C are excited with equal amplitudes and opposite phases, and port B and D are excited with equal amplitudes and opposite phases. Ports 1 and 2 are the vertically and horizontally-polarized antenna stripline ports.

In an another example, the layout of the stripline feed network 617 may also be a microstripline network, in which case the lowest metal layer M6 may not needed. One advantage of stripline over microstrip is improved shielding which could be important in some applications. The stripline PCB is mechanically symmetrical in its stackup which may reduce warping.

Any balun of sufficient bandwidth may be used to feed a balanced AMC antenna element. Any planar four-port 180° hybrid would serve this function. Other examples include ring hybrids with non-uniform ring impedances, Marchand baluns, Shiffmann phase shifters, lattice baluns, and many other concepts. In an aspect, the balun may be disposed above the AMC surface at the feed location of the balanced antenna element providing that the volume occupied by the balun is sufficiently small.

Figure 7:
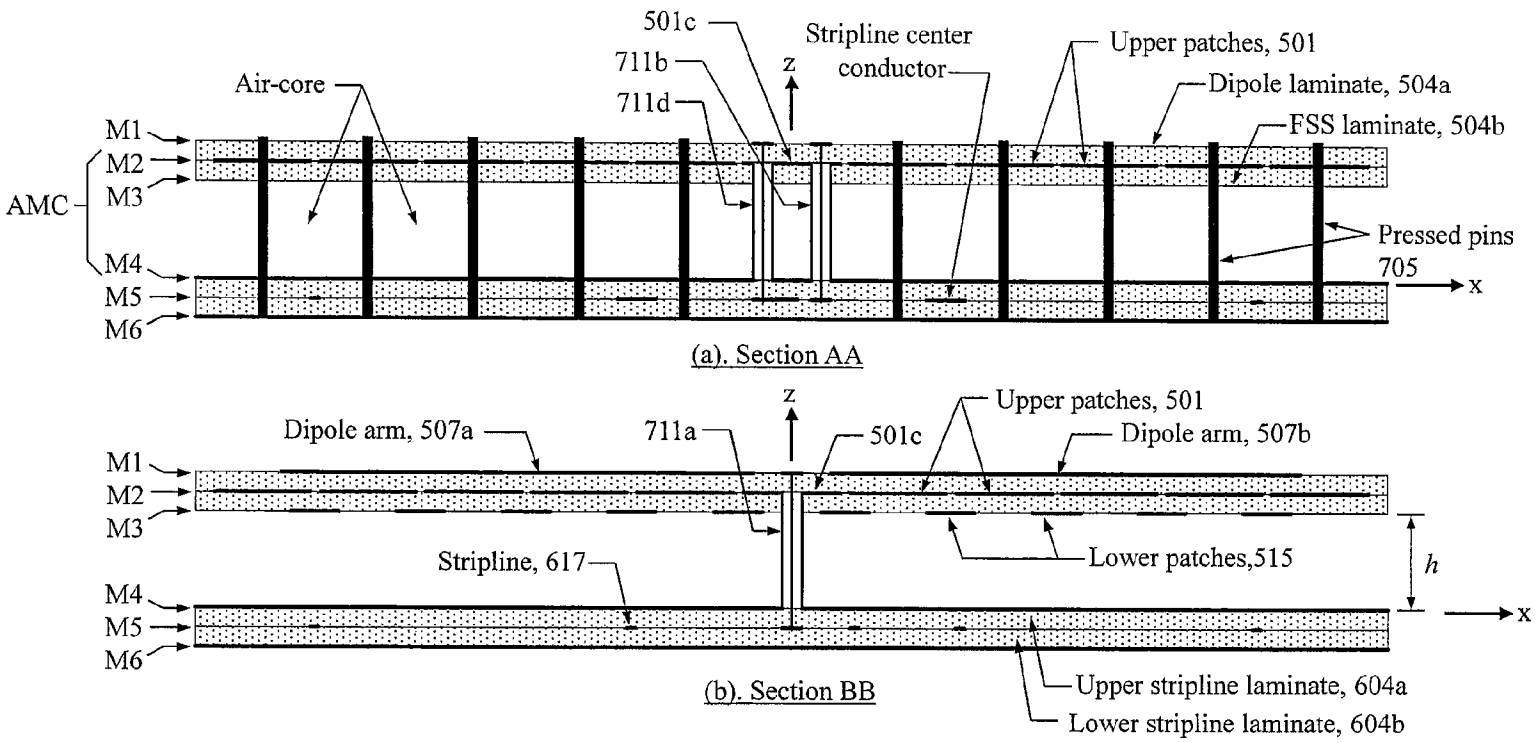
FIG. 7 shows the elevation views corresponding to section cuts AA and BB in FIG. 5.

FIG. 7(*a*) is an elevation view of the dual-polarized AMC antenna through section cut AA of FIG. 5. This air-core AMC antenna is comprised of two multi-layer PCBs, each having three metal layers. The upper PCB 504 has a dipole laminate 504*a* and a capacitive FSS laminate 504*b* bonded together. Upper patches 501 of the capacitive FSS are formed in metal layer M2. The central patch is denoted 501*c*. The lower PCB 604 is a stripline structure wherein the upper metal layer M4 serves as the RF backplane for the AMC and also serves as the stripline upper ground plane. The AMC is comprised of metal layers M2, M3, and M4. The stripline feed network employs metal layers M4, M5, and M6 where M5 contains the stripline center conductor.

FIG. 7(*b*) is an elevation view of the dual-polarized AMC antenna through section cut BB in FIG. 5. This cut shows the horizontally-polarized dipole arms 507*a* and 507*b*, the upper patches 501, and the lower patches 515 of the capacitive FSS. Note that the pressed pins 705 penetrate both multi-layer PCBs, and maintain a uniform spacing distance h between the PCBs. Four coaxial transmission lines route balanced signals vertically through the air core of the AMC. FIG. 7(*a*) shows coaxial transmission lines 711*b* and 711*d* which are excited by stripline feed ports B and D. FIG. 7(*b*) shows coaxial transmission line 711*a* which is excited by stripline feed port A. The outer conductor of these coaxial transmission lines is electrically connected to the RF backplane (layer M4) and to the central patch 501*c* in the array of upper patches 501 in layer M2. The coaxial transmission lines are shielded and thus prevent energy coupling from the feed network into the air-core of the AMC.

Figure 8:
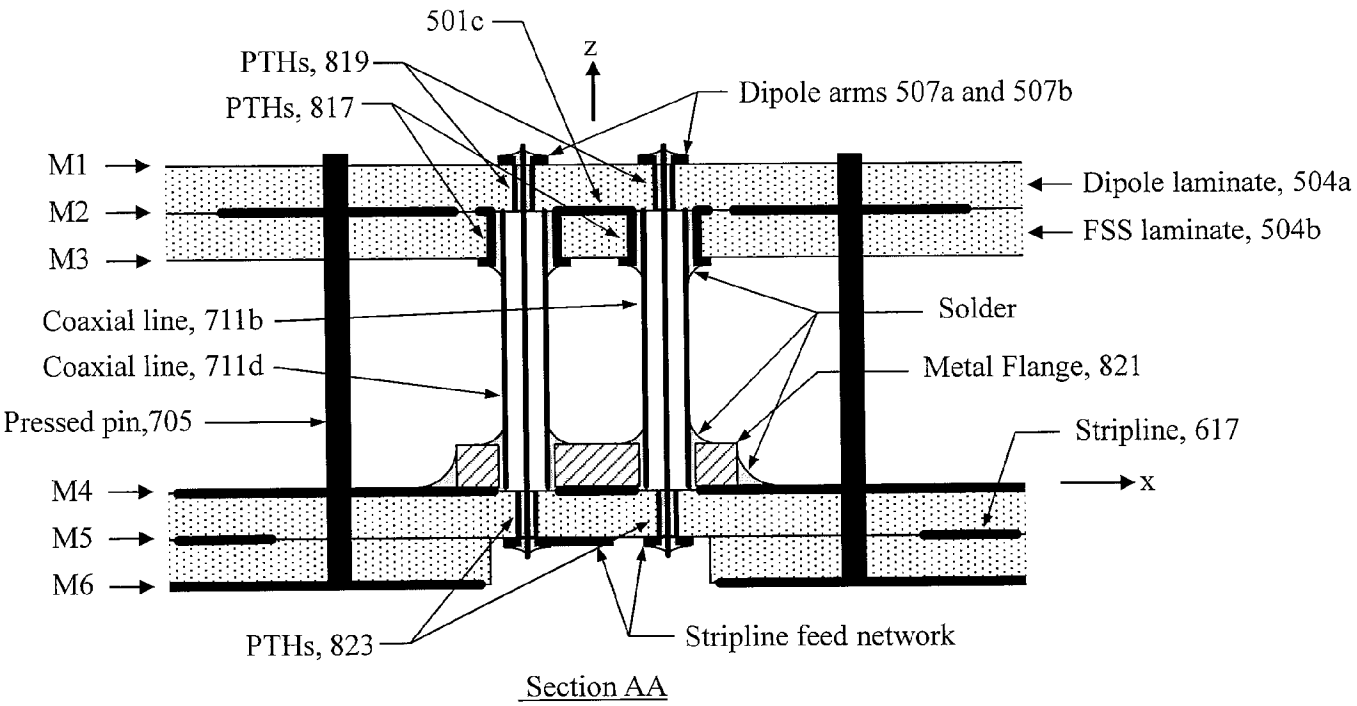
FIG. 8 shows a detailed view of section AA from FIG. 5 in the vicinity of the coaxial feedlines.

FIG. 8 shows a detailed view of the feed structure in the center of the antenna. Section cut AA of FIG. 5 intersects a pair of balanced coaxial transmission lines, 711*b* and 711*d*. The coaxial cables may be, for example, 50Ω Cu-clad semi-rigid coax, with 0.087" O.D. The FSS laminate 504*b* may have PTHs 817 fabricated therein to capture the coaxial cables. The outer conductors of 711*b* and 711*d* may be soldered to PTHs 817 in the FSS laminate which are electrically connected the central patch 501*c*. The inner conductors of 711*b* and 711*d* may be soldered to PTHs 819 in the dipole laminate 504*a* which are electrically connected to traces forming the dipole arms 507*a* and 507*b*.

The lower end of the coaxial cables may be held in place with a machined metal flange 821 that may be formed with holes sized to accept the semi-rigid coaxial cables. The perimeter of the flange 821 may be soldered to the AMC backplane which is metal layer M4. The outer conductors of the semi-rigid coax may be soldered to the flange 821. The lower ends of the coaxial center conductors may be soldered to PTHs 823 which are electrically connected to the center conductor of the stripline feed network on metal layer M5.

Tuning of AMC antenna elements may be needed to realize their full bandwidth potential. An effective location to incorporate a matching network is at the surface of the dipole laminate which supports a dipole or other antenna element(s). In an aspect, lumped matching elements may be incorporated above the AMC and at the driven end of the antenna elements.

Figure 9:
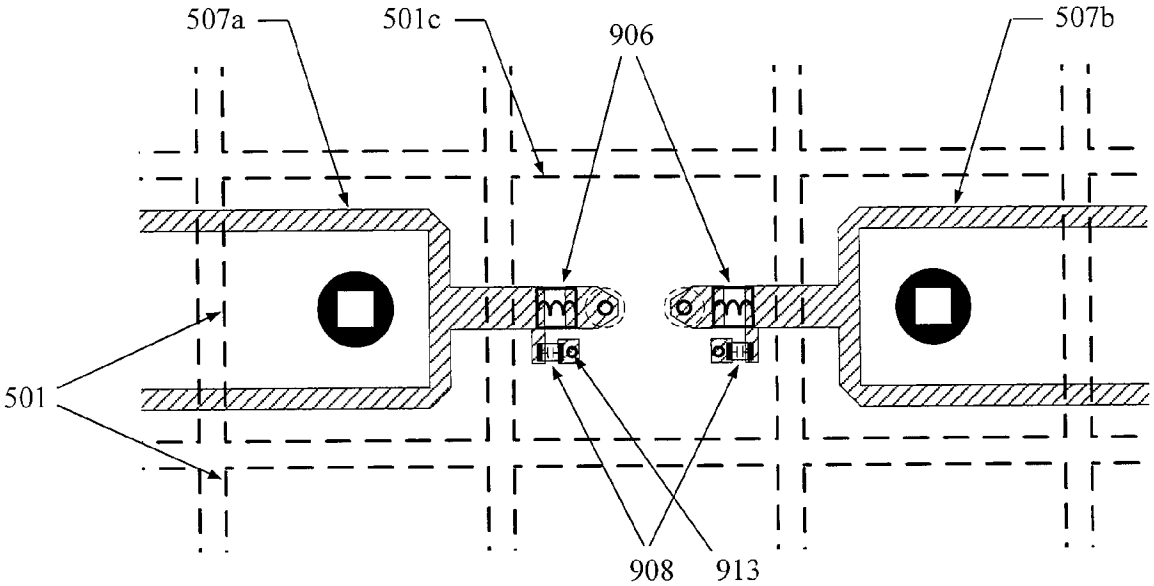
FIG. 9 shows a plan view of a matching network incorporated into an antenna element.

An example of an impedance matching network is shown in FIG. 9 where only metal layers M1 and M2 are shown along with a pair of coaxial feedlines and the bifurcated dipole arms 507*a* and 507*b*. Lumped inductances 906 are connected in series with the dipole arms. Lumped capacitances 908 may be placed in shunt between the dipole arms 507*a*, 507*b* and the central patch 501*c*. These inductances and capacitances form a pair of LC matching networks, one for each dipole arm. The lumped inductances and lumped capacitances may be located directly above the center patch 501*c*, and they may be realized, for example, using surface mounted components attached to the dipole laminate 504*a*. PTHs in the dipole laminate 504*a* such as 913 may be used to connect (ground) one end of the lumped capacitance to the central patch 501*c*. The local ground plane for this impedance matching network is the central conductive patch 501*c* of the capacitive FSS. This is possible due to the use of shielded coaxial feedlines whose outer conductors electrically connect the central patch 501*c* to the AMC RF backplane.

Figure 10:
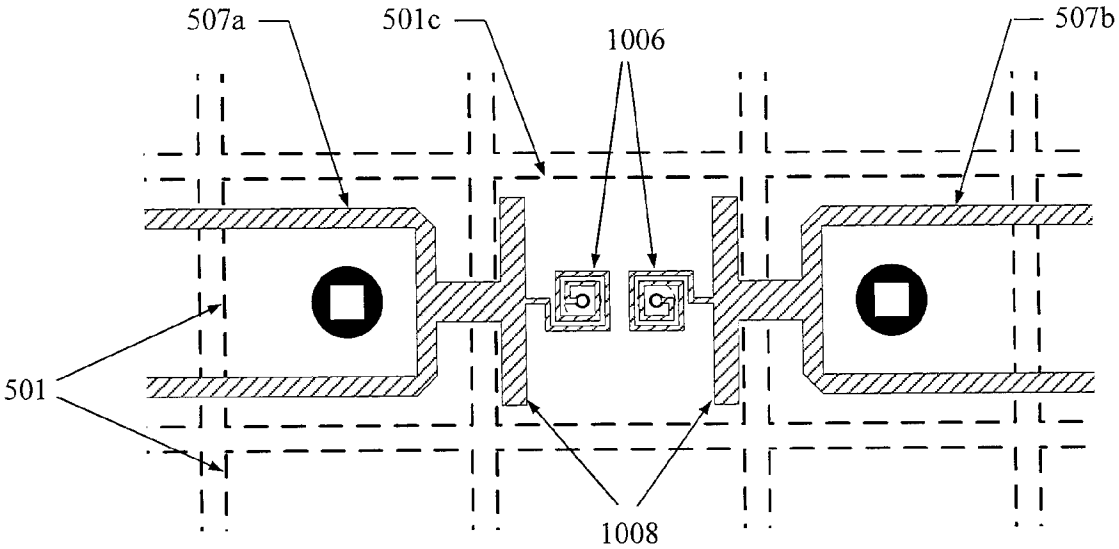
FIG. 10 shows another plan view of a matching network incorporated into an antenna element.

FIG. 10 illustrates an alternative impedance matching network where the series inductances may be realized with spiral printed inductors 1006. Alternatively, printed meander lines may be used in place of the spirals. The shunt capacitance to ground (which is the central patch 501*c*) may be realized, for example, with open circuited microstrip lines 1008.

A person of skill in the art will appreciate that the balanced LC impedance matching networks shown in FIGS. 9 and 10 may also be applied to an unbalanced antenna element, such as a bent-wire monopole, where only one coaxial feedline is required. Only one inductance and one capacitance may be needed. Furthermore, an L-match is not the only possible matching circuit topology. Any matching circuit topology is usable providing that the circuit fits within the area of the capacitive patch 501*c* which is grounded to the RF backplane by the coaxial feedline, such as L-section, Pi, and Tee matching networks, as examples.

Where a balanced antenna element such as a dipole is being fed, each of the two coaxial feedlines may terminate on or be grounded to adjacent patches as illustrated in FIG. 4. This arrangement may provide more space for a local matching network. In other examples, lumped element or printed circuit matching networks may be distributed along the length of the antenna element(s). Antenna tuning is also possible where capacitance 908 is a voltage tunable capacitor. A bias voltage for the tunable capacitance may be superimposed on the center conductor of the coaxial feed line(s).

In another example of a specific design of an AMC antenna similar to the configuration in FIGS. 5-8, consider an air-core AMC designed to have a surface-wave bandgap that covers 690 MHz to 960 MHz. This may be realized by using a square lattice AMC with period P=22 mm and a height h=24 mm between RF backplane and the inside of the capacitive FSS laminate. The capacitive FSS laminate may have a relative permittivity of 3 and a thickness of 0.5 mm. Upper and lower patch sizes are 21 mm and 8 mm which yield a gap of 1 mm between upper patches on the M2 layer. One construction of the AMC uses pressed pins of square cross section and size 1 mm sq.×27 mm in length.

The AMC antenna system in this example may have an array of 9×9 unit cells with an overall footprint of 198 mm square. This AMC has a physical aperture area of about 0.528 $\lambda_o$ sq. at 800 MHz; the dipole laminate is 1 mm thick and the RF backplane is 1.5 mm thick. The total AMC antenna thickness is then 27 mm which, at 800 MHz, is about $\lambda_o/14$.

In this example, two equal length orthogonal dipoles result in a dual linearly polarized antenna. The overall dipole length is 192 mm. The four coaxial cables, 711*a*, 711*b*, 711*c*, and 711*d*, each coaxial cable spanning the air-core AMC, has characteristic impedance of 50 Ohms. A lumped LC matching network is employed above the central patch 501*c* as shown in FIG. 9 to tune the antenna performance for best return loss over the frequency range 690 MHz to 960 MHz. The inductance and capacitance values used were 11 nH and 0.82 pF. This AMC antenna was modeled using a full-wave TLM (transmission line matrix) simulation tool; MICROSTRIPES 2012 from CST (Framingham, Mass.).

Figure 11A:
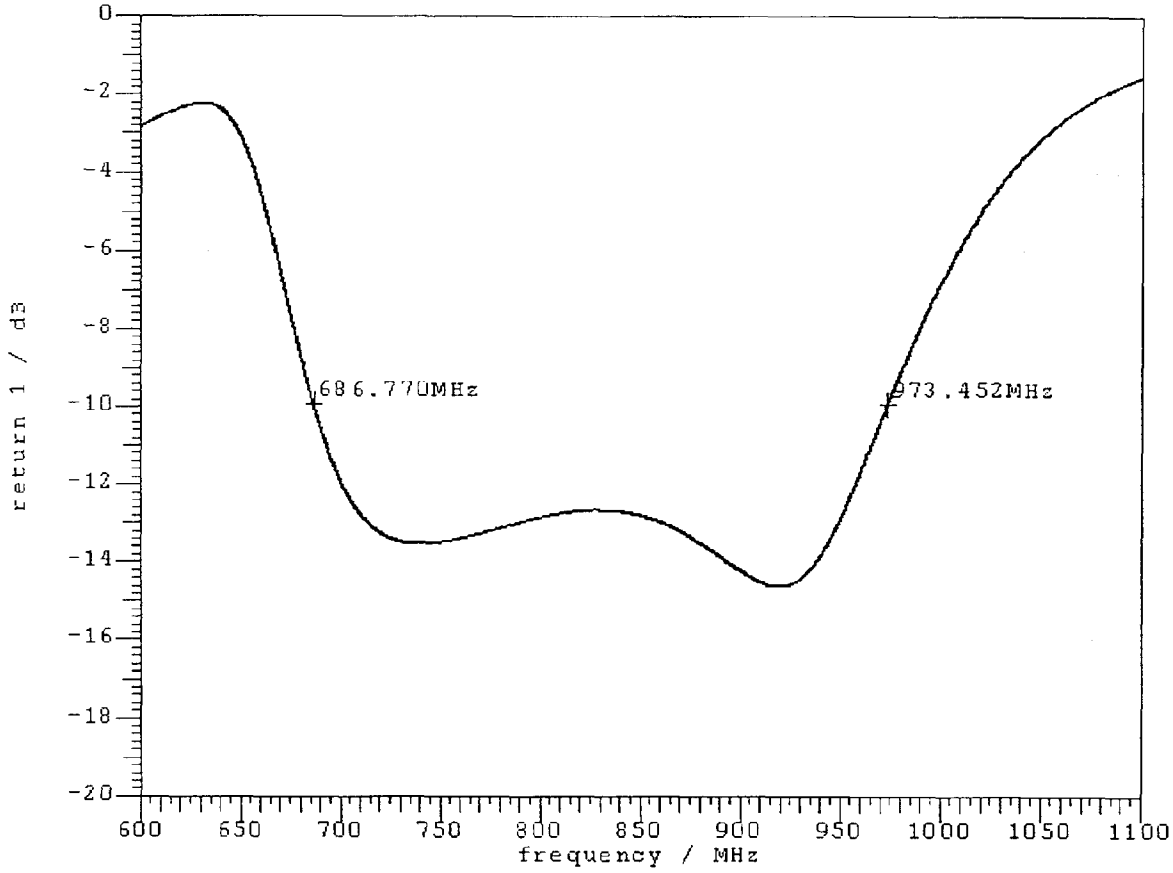
FIG. 11A shows the reflection coefficient plot and FIG. 11B shows the corresponding Smith Chart plot if impedance for an example AMC antenna.
Figure 11B:
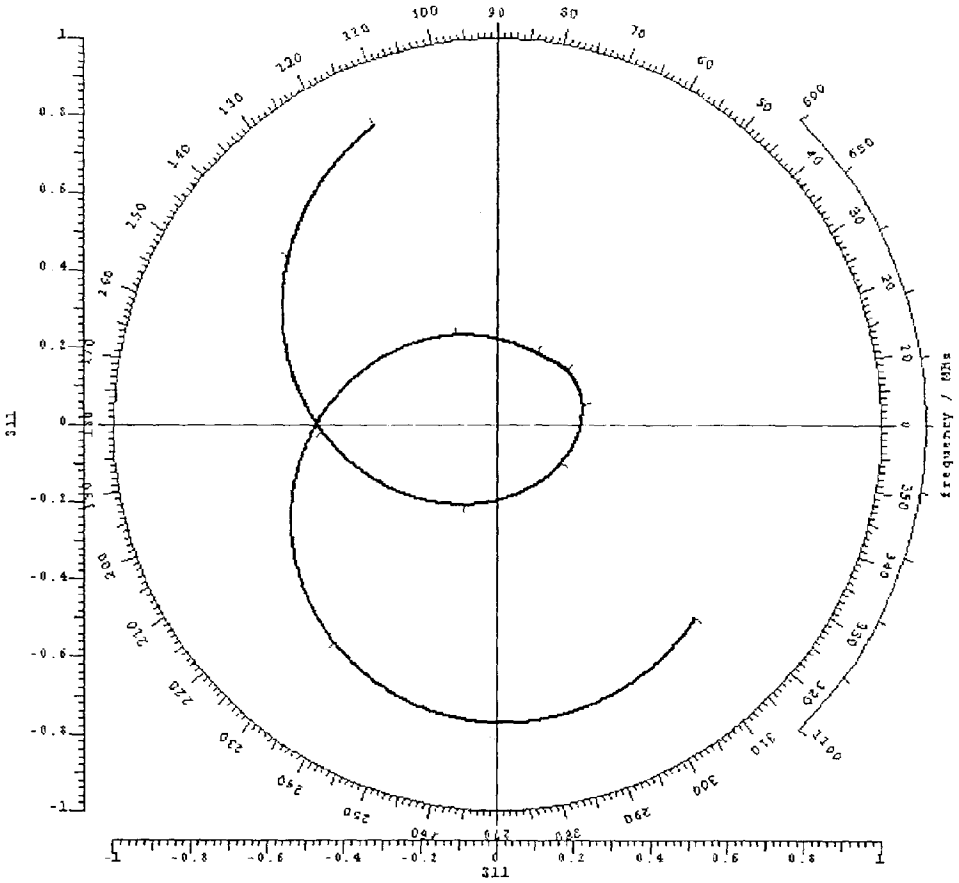

FIG. 11(*a*) shows the simulated reflection coefficient, $|S_{11}|$, for the example AMC antenna, which is better than −10 dB over 687 MHz to 973 MHz, resulting in a fractional frequency bandwidth of about 34.4%. The corresponding impedance locus in the Smith Chart of FIG. 11(*b*) is simulated at the reference plane of the central patch, at the end of a 50 ohm coaxial feedline. This simulation of antenna input impedance does not include a balun, but it does include an LC matching network. However, a conventional 6λ/4 rat-race balun with 50 ohm ports and a 70.7 ohm ring will exhibit a 20 dB return loss at its difference port over a 35% fractional frequency bandwidth (690 MHz to 960 MHz). A circuit simulation of the rat-race balun feed network with dipole termination impedances from the MICROSTRIPES full-wave antenna simulation showed that a 10 dB return loss is maintained over 690 MHz to 960 MHz at the dual polarized antenna ports. The predicted port 1 return loss is similar to that shown in FIG. 11(*a*).

Figure 12:
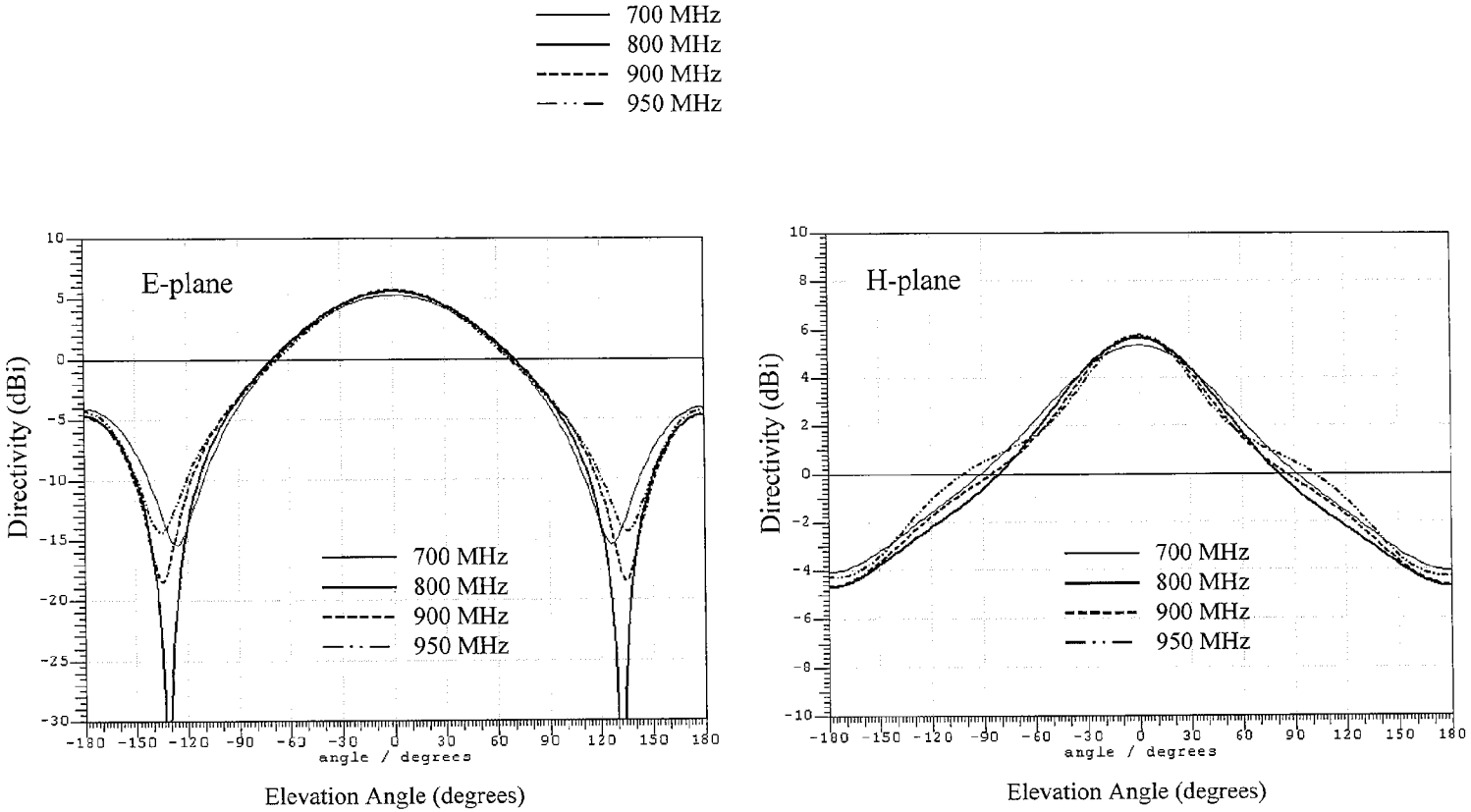
FIG. 12 shows the principal plane directivity patterns for an example AMC antenna.

FIG. 12 shows the principal plane directivity patterns for one polarization of the dual-polarized AMC antenna example. E-plane and H-plane pattern cuts show that the broadside directivity along the z axis exceeds 5.3 dBi over the frequency range 700 MHz to 950 MHz. These directivity plots show that the antenna pattern is quite stable over this frequency range. The E-plane and H-plane half-power beamwidths are approximately 44° and 49° respectively. The front-to-back ratio is about 10 dB over this frequency range.

Figure 13:
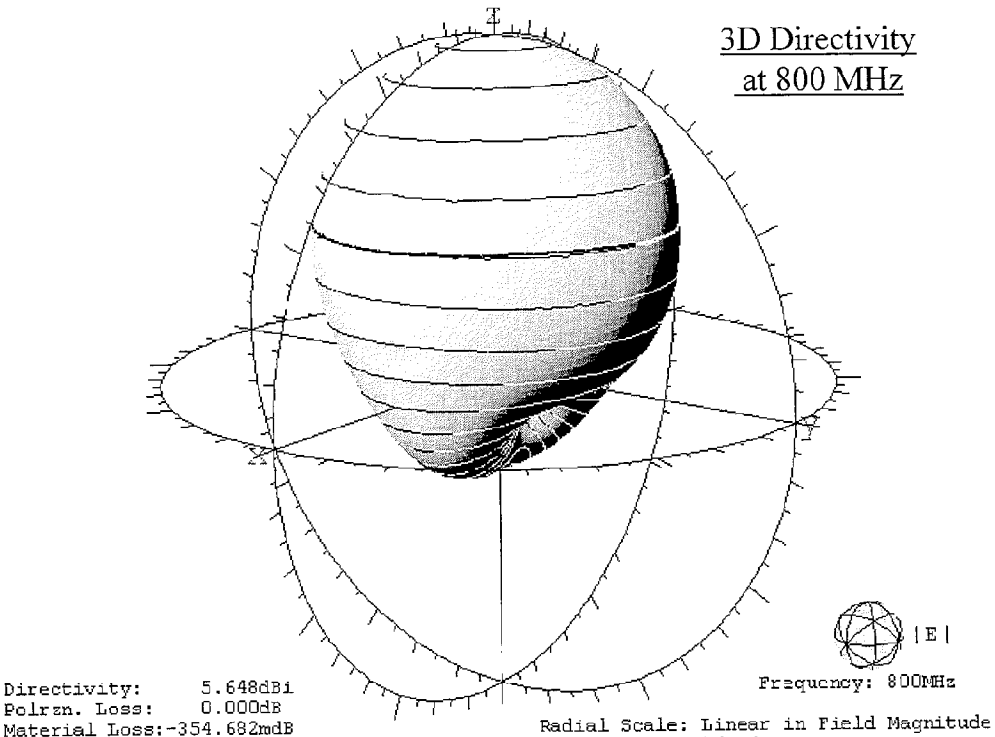
FIG. 13 shows a three dimensional plot of antenna pattern for an example AMC antenna.
Figure 14:
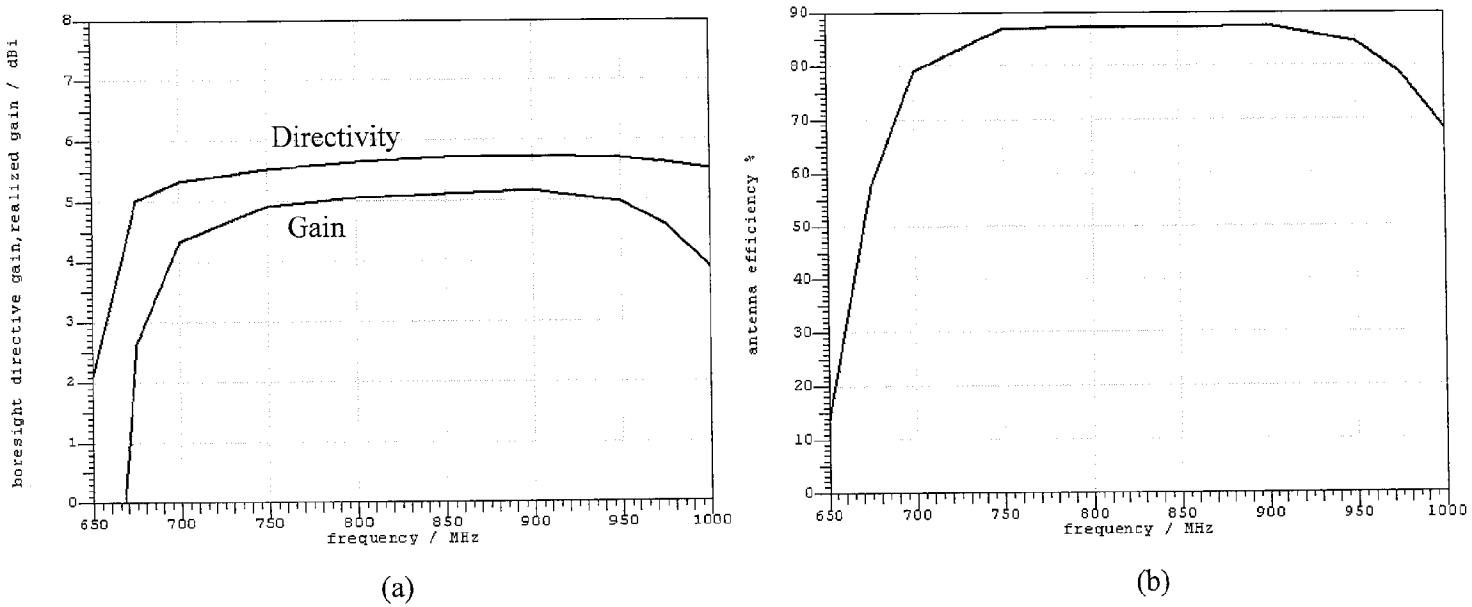
FIG. 14 shows a plot of directivity, gain, and antenna efficiency for an example AMC antenna.

A plot of the 3D directivity pattern for one polarization is shown in FIG. 13 for the midband frequency of 800 MHz. The directivity peaks at 5.65 dBi along the +z axis, which is normal to the AMC surface. The peak gain is about 5 dBi at 800 MHz. This is a linear plot of the far-field magnitude. The darker line circumscribing the main beam is the −3 dB directivity contour. FIG. 14(*a*) shows a plot of the boresight directivity and gain as a function of frequency. This plot suggests a stable antenna performance where the directivity is substantially flat from 700 MHz to 1000 MHz, between about 5.4 dBi and about 5.75 dBi.

In FIG. 14(*a*), the difference in decibels (dB) between the directivity and gain curves arises from the efficiency of the AMC antenna of this example. Losses may include conductor loss in the brass pressed pins and in the Cu metal of the PCBs, and dielectric loss in the dipole laminate and FSS laminate which was modeled as Rogers RO3003 (Rogers Corp., Rogers, Conn.). A balun was not included in the full-wave simulation and therefore the balun loss is not included in the calculation of antenna efficiency. Also, the LC matching network was defined to be lossless for purposes of simulation.

A plot of the simulated realizable antenna efficiency is shown in FIG. 14(*b*) where the y axis is percentage. The realizable antenna efficiency is band limited by the mismatch loss: $(1-|S_{11}|^2)$.

The vias or pressed pins in the AMC connecting the FSS to the backplane are effective to enhance the antenna return loss bandwidth, realizable antenna efficiency, and front-to-back ratio. To illustrate this aspect, the dual-polarized antenna example model whose results are shown in FIGS. 11-14 was modified by deleting the pressed pins. Without a matching network, the resulting simulated return loss of the modified antenna degrades to 2 dB best case for any frequency below 1 GHz.

An optimized matching network at each dipole arm consisting of a series 28 nH inductance and no shunt capacitance was used to tune the dipole antenna elements to resonate near 850 MHz. For each dipole, the two series inductances 906 of value 28 nH are located above patch 501*c* as shown in FIG. 9.

Figure 15:
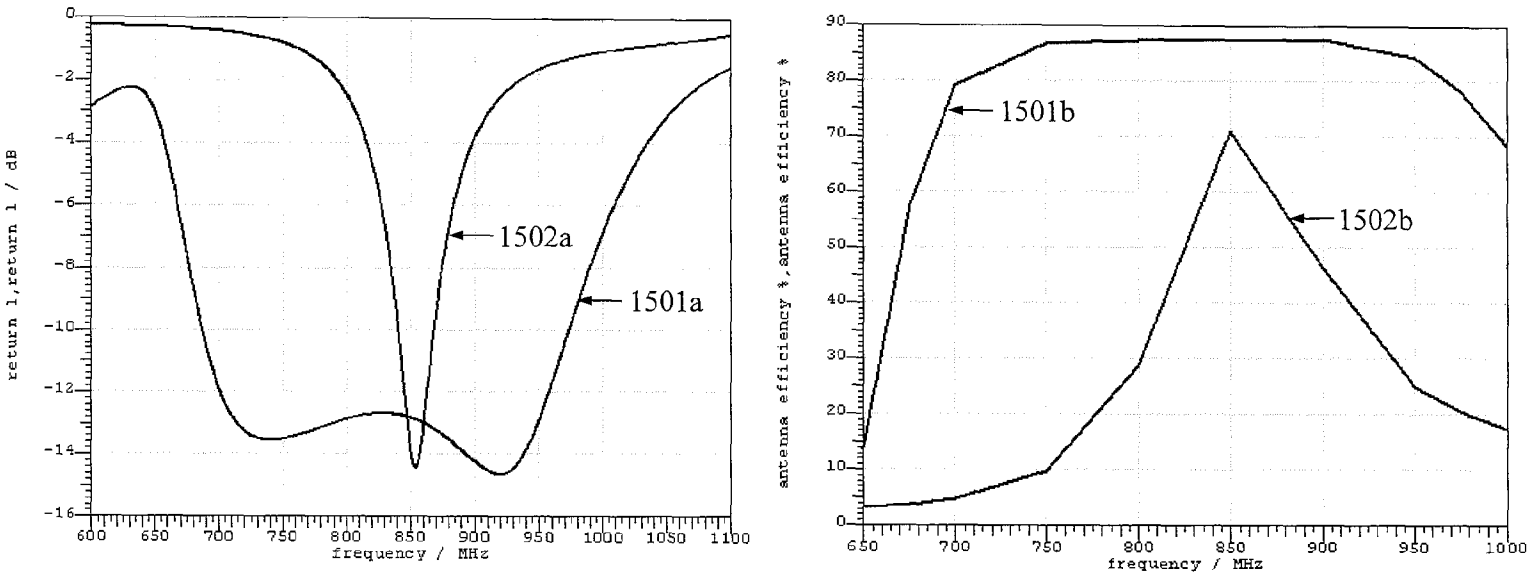
FIG. 15(*a*) shows a comparison of simulated return loss in dB for the antenna example which uses pressed pins (curve 1501*a*) versus the modified antenna example without pressed pins, (curve 1502*a*); and, (b) shows a comparison of the simulated realizable antenna efficiency for the antenna example which uses pressed pins (curve 1501*b*) versus the modified antenna example without pressed pins as a spacer, (curve 1502*b*)

FIG. 15(*a*) shows a comparison of simulated return loss in dB for the antenna example which uses pressed pins (curve 1501*a*) versus the modified antenna example without pressed pins (curve 1502*a*). The antenna example without pressed pins has a 10 dB return loss bandwidth of about 18 MHz when tuned to resonate near 850 MHz. This is a fractional bandwidth of about 2.1%, or about 16 times less than the 10 dB return loss bandwidth of the same size AMC antenna which employs pressed pins as a spacer.

FIG. 15(*b*) shows a comparison of the simulated realizable antenna efficiency for the antenna example which uses pressed pins (curve 1501*b*) versus the modified antenna example without pressed pins as a spacer (curve 1502*b*). This comparison assumes lossless matching networks. The peak realizable antenna efficiency of the antenna example without pressed pins is about 71% at 850 MHz, whereas the antenna example with pressed pins has a realizable antenna efficiency exceeding 80% over 706 MHz to 968 MHz. Balun losses are not included in this evaluation.

Figure 16:
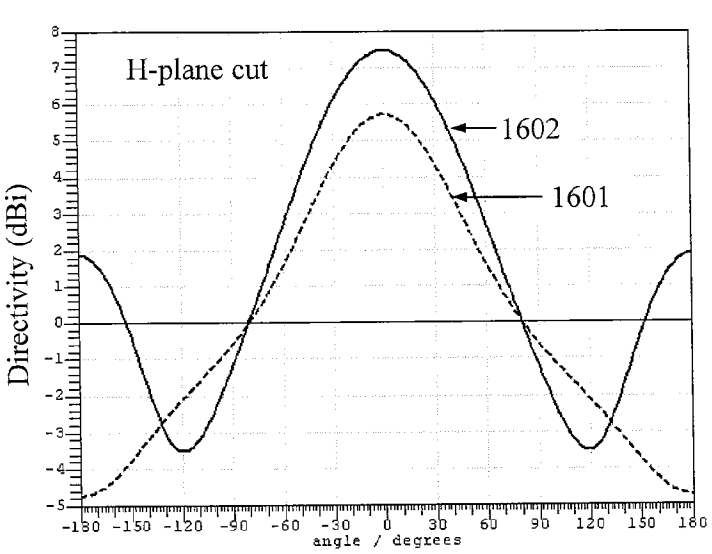
FIG. 16 shows (a) shows the 3D directivity pattern at 850 MHz for the antenna example without pressed pins; and, (b) shows a comparison of the H-plane directivity cuts for the antenna example which uses pressed pins (curve 1601) versus the modified antenna example without pressed pins, (curve 1602).
Figure 16:
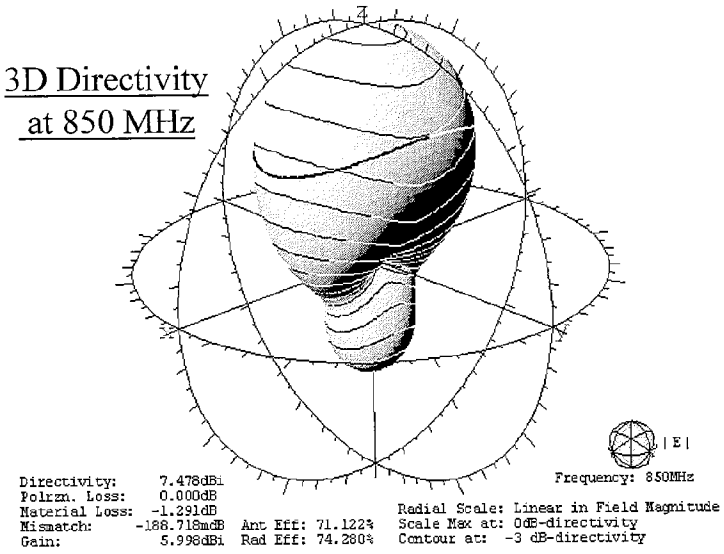

FIG. 16(*a*) shows the 3D directivity pattern at 850 MHz for the antenna example without pressed pins. FIG. 16(*b*) shows a comparison of the H-plane directivity cuts for the antenna example which uses pressed pins (curve 1601) versus the modified antenna example without pressed pins (curve 1602). Although the antenna without pressed pins has about 1.8 dB more boresight directivity, its front-to-back ratio has degraded to about 5.6 dB. Without pressed pins, the antenna pattern for the dual-polarized antenna example radiates more of its input power into the lower hemisphere of z<0.

While these comparisons were based on the examples using the pressed pins as the electrical connection between the FSS and the RF backplane, this same comparison could be made where plated through hole vias in a PCB were used to perform the same electromagnetic function.

The AMC antenna examples shown above include antenna elements which are a linear bent-wire monopole, a linear dipole, and a dipole with bifurcated arms. Other options include, for example, dipoles with unequal arm lengths, or bifurcated dipoles with two or more parallel traces (fingers) per arm. The dipole arms may have multiple fingers which need not be the same length. Other antenna elements include bowties, batwing shapes, rhombic shapes, rectangular meshes, and the like. The dielectric and conducting materials described in the above examples are representative of some typical applications in antenna systems. Many other material choices are possible, and the selection of materials is not considered a limitation, as each material used may be characterized and analyzed using simulation software to provide design parameters. Dielectric layers may include organic, inorganic, or composite materials. In addition to air (or a vacuum), dielectric materials may be semiconductors (Si, SiGe, GaAs, InP), ceramics (Al2O3, MN, SiC, BeO) including low temperature co-fired ceramic (LTCC) materials, and plastic materials such as liquid crystal polymer. Dielectric layers may differ in thickness from the examples shown. The dielectric layers forming the capacitive FSS and the backplane need not be made of the same materials. Metals may include, for example Al, Cu, Au, Ag, W, or Mo, and metal alloys (FeNiCo (Kovar), FeNiAg (SILVAR), CuW, CuMo, Al/SiC) and other materials having similar electromagnetic properties. Metals used in the capacitive FSS may be different from metals employed for the vias, coaxial feedlines, backplane, or balanced feed network integrated into the backplane. The selection of materials may be determined by manufacturing and durability considerations.

The conductive patches in the capacitive FSS may contain patterns more elaborate than simple square patches, such as circular, rectangular, hexagonal, any polygonal shape, or inter-digital patches. Patch corners may be rebated or mitered. Some of the conductive patches forming the capacitive FSS may be left floating rather than being connected to conductive vias as shown in FIG. 5. Ratios of key dimensions may differ from illustrations presented. The AMC examples shown above imply unit cells arrayed on a square lattice, but that is not a limitation as rectangular, hexagonal, triangular, or other lattice shapes are possible for the AMC unit cell layout.

Furthermore, the antenna systems of the examples may use additional layers to make a manufacturable product or for other purposes, some of which may be functional. For instance, relatively thin prepreg layers may be used for adhesion between thicker dielectric core layers in a printed wiring board stackup. Exterior insulating layers such as a solder mask may be added for environmental protection and manufacturing yield. Passivation layers or conformal coatings may be added to protect metal layers from oxidizing. All of these additional manufacturing-process related layers are typically thin with respect to the thicknesses of key dielectric layers such as substrates and superstrates, and effect of these thin layers may be viewed as a perturbation to the ideal antenna performance predicted without these layers. They may, of course, be included in any simulation for improved accuracy.

In the preceding, only a finite number of unit cells are illustrated: fewer than 150 per figure. However EBG structures may contain hundreds or even thousands of unit cells within a particular antenna system. Yet, not all of the available area within the footprint of an antenna system may be utilized for an AMC surface.

Furthermore, it should be understood that all of the AMC unit cells need not be identical in a particular antenna system. The surface-wave stopband, or bandgap, may be designed to have differing properties in various portions of the antenna system so as to create, for example, a broader band or a multi-band antenna system. There may also be antenna elements in the same antenna system wherein the AMC and the dipoles are tuned to different center frequencies. A particular antenna design may be used where there are multiple frequency bands supported in an antenna system and, hence, may employ an AMC tuned to different stopbands in different physical locations.

Although only a few exemplary embodiments of this invention have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

The invention claimed is:

1. An electromagnetic radiating structure, comprising:

a frequency selective surface (FSS) comprised of a coplanar array of conductive patches;

a substantially continuous conductive plane spaced apart from the FSS;

a dielectric layer disposed between the FSS and the substantially continuous conductive plane;

a conductive portion disposed facing a side of the FSS distal from the conductive plane;

a transmission line having an outer conductor and an inner conductor; and a plurality of conductive elements each element connecting a conductive patch to the substantially continuous conductive plane, wherein the outer conductor of the transmission line is connected to the substantially continuous conductive plane and the outer conductor extends through the dielectric layer to connect to a conductive patch of the array of conductive patches; and, the inner conductor of the transmission line is connected to the conductive portion.

2. The structure of claim 1, wherein the conductive portion is a conductor disposed above and parallel to the FSS.

3. The structure of claim 1, wherein the dielectric layer is selected from at least one of a solid or a gas.

4. The structure of claim 1, wherein the conductive elements are formed as plated through holes (PTH) in a printed circuit board (PCB).

5. The structure of claim 1, wherein the conductive elements are formed as pins such that at least a pin connects a conductive patch to the substantially continuous conductive plane and a plurality of pins form a stable structure with the conductive patch and the substantially continuous conductive plane.

6. The structure of claim 1, wherein the conductive portion comprises a first and a second conductive portions, each portion disposed on a side of the FSS distal from the substantially continuous conductive plane.

7. The structure of claim 6, wherein the transmission line comprises a first transmission line and a second transmission line, and the outer conductor of the first transmission line and the outer conductor of the second transmission line are connected to the substantially continuous conductive plane and to a conductive patch of the array of conductive patches, and the inner conductor of the first and the second inner conductors are connected to the first and the second conductive portions, respectively.

8. The structure of claim 7, wherein the first and the second transmission lines are connected to the same conductive patch of the array of conductive patches.

9. The structure of claim 8, wherein the first and the second transmission lines are fed with a voltage having equal amplitude and opposite phase.

10. The structure of claim 6, wherein the first and the second conductive portions form a planar dipole.

11. The structure of claim 10, wherein at least one of the first and the second conductive portions is comprised of a plurality of conductive portions disposed to avoid a pin supporting a surface including the conductive portions.

12. The structure of claim 6, further comprising a third and a fourth conductive portion, the first and second conductive portions and the third and fourth conductive portions disposed to form a pair of orthogonal dipoles.

13. The structure of claim 1, wherein the coplanar array of conductive patches is part of a first printed wiring board, the substantially continuous conductive plane is part of a second printed wiring board, and the conductive elements are pins joining the first and the second printed wiring boards.

14. The structure of claim 1, further comprising a second array of coplanar patches, disposed in a different plane than the first array of conductive patches, the second array of patches not being connected to the conductive elements.

15. The structure of claim 1, wherein a feed network is disposed on an opposite side of the substantially conductive plane from the FSS.

16. The structure of claim 1, wherein an impedance matching network is connected between the inner conductor of the coaxial transmission line and the conductive portion.

17. The structure of claim 16, wherein the conductive portion is an antenna element and the matching network is disposed in a feed region of the antenna.

18. The structure of claim 17, wherein the impedance matching network is comprised of at least one of an inductor or a capacitor.

19. The structure of claim 18, wherein the impedance matching network comprises an inductor placed in series with an arm of the antenna; and, a capacitor placed in parallel between the arm and the conductive patch of the array of conductive patches.

20. The structure of claim 19, wherein the inductor or capacitor of the impedance matching network are discrete components.

21. The structure of claim 19, wherein at least one of the inductor or the capacitor of the impedance matching network are printed conductors on a printed wiring board.

22. The structure of claim 1, wherein the outer conductor of the transmission line extends through a dielectric region between the substantially continuous conductive plane and the coplanar array of conductive patches.

23. An antenna system, comprised of:

an artificial magnetic conductor configured to have a surface-wave bandgap, comprising:

a frequency selective surface (FSS);

a substantially continuous conductive surface disposed apart from the FSS;

a dielectric layer disposed between the FSS and the substantially continuous conductive surface;

a plurality of conductive elements connecting the FSS and the substantially continuous conductive surface;

an antenna disposed such that the FSS lies between the antenna and the substantially continuous conductive surface; and a transmission line having an outer conductor and an inner conductor penetrating the substantially continuous conductive surface and having the outer conductor connected to the continuous conductive surface and the outer conductor extending through the dielectric layer to connect to the FSS, and the inner conductor connected to a feed point of the antenna.

24. The antenna system of claim 23, wherein the FSS is a co-planar array of patches.

25. The antenna system of claim 24, wherein the conductive elements are one of plated-through holes in a dielectric material, pins or stakes through an air dielectric region.

26. The antenna system of claim 24, wherein the FSS, the substantially continuous conductive plane and the conductive elements form an artificial magnetic conductor (AMC); and, the antenna is configured to radiate energy supplied by the transmission line over a bandwidth within a band gap of the AMC.

27. The antenna system of claim 23, wherein the dielectric layer is air.

28. The antenna system of claim 23, wherein the transmission line is a semi-rigid coaxial cable.

29. The antenna system of claim 24, wherein the conductive elements are pins or stakes and the dielectric layer is substantially air.

30. The antenna system of claim 24, wherein the conductive elements are plated through holes (PTH) in a printed wiring assembly (PWA).

31. The structure of claim 24, wherein the outer conductor of the transmission line extends through the dielectric layer between the substantially continuous conductive plane and the co-planar array of conductive patches.

* * * * *